US007243662B2

(12) United States Patent
Girard

(10) Patent No.: US 7,243,662 B2
(45) Date of Patent: Jul. 17, 2007

(54) HAIR TWISTER

(76) Inventor: Gregg Giovanni Girard, 10331/2 S. Mansfield Ave., Los Angeles, CA (US) 90019

( * ) Notice: Subject to any disclaimer, the term of this patent is extended or adjusted under 35 U.S.C. 154(b) by 195 days.

(21) Appl. No.: 10/918,098

(22) Filed: Aug. 16, 2004

(65) Prior Publication Data

US 2006/0032514 A1 Feb. 16, 2006

(51) Int. Cl.
*A45D 6/14* (2006.01)
*A45D 2/24* (2006.01)

(52) U.S. Cl. ..... 132/251; 132/256

(58) Field of Classification Search ..... 132/245, 132/246, 247, 248, 249, 250, 251, 252–265
See application file for complete search history.

(56) References Cited

U.S. PATENT DOCUMENTS 2,768,633 A * 10/1956 Baumeister ..... 132/262
2,789,565 A * 4/1957 Voorhees ..... 132/207
2,941,534 A * 6/1960 Otto et al. ..... 132/251
3,003,505 A 10/1961 Otto et al.
3,064,659 A * 11/1962 Solomon ..... 132/251
3,073,318 A 1/1963 Catania
3,097,657 A * 7/1963 Solomon ..... 132/262
3,209,766 A * 10/1965 Dannat ..... 132/262
3,707,155 A 12/1972 Lemberg
3,838,700 A * 10/1974 Barrios ..... 132/254
3,933,161 A * 1/1976 Strickman et al. ..... 132/238
3,991,774 A 11/1976 Wolfthal
4,004,595 A * 1/1977 Slavinski ..... 132/242
5,082,011 A 1/1992 Wu
5,261,428 A 11/1993 Wu
5,605,166 A 2/1997 Chou

* cited by examiner

*Primary Examiner*—Robyn Doan

(57) ABSTRACT

A hair fastening device having the ability to be rolled into a person's hair and then secured within the hair by sliding the device together. The device can be more tightly secured by adding an additional piece which can be attached to the device and concealed within the person's hair. This invention provides a person a manner to create a variety of hair styles with a concealed hair fastener.

6 Claims, 2 Drawing Sheets

HAIR TWISTER

REFERENCES CITED

U.S. Patent Documents

U.S. Pat. No. 5,605,166
U.S. Pat. No. 5,261,428
U.S. Pat. No. 5,082,011
U.S. Pat. No. 3,991,774
U.S. Pat. No. 3,707,155
U.S. Pat. No. 3,209,766
U.S. Pat. No. 3,097,657
U.S. Pat. No. 3,073,318
U.S. Pat. No. 3,064,659
U.S. Pat. No. 3,003,505
U.S. Pat. No. 2,941,534

BACKGROUND OF THE INVENTION

1. Field of Invention

This invention relates to hair fastening devices, and more particularly to devices which are wrapped in the hair and then secured.

2. Description of the Prior Art

Hair combs and related hair fastening devices, such as hair pins and hair clips with toothed leaf-spring elements. Devices with separate pins or prongs can be concealed while securing hair but fail to maintain the integrity of the style during use and the accuracy of the style in repeated use. Other devices that fasten by clips or other hinged elements are difficult to conceal and as a result are often decorative rather than unseen. Therefore it has been the practice of merchants to use a combination of devices to achieve a desired style or to conceal the fastener.

Therefore it would be desirable to provide a single device that can be concealed within the hair and securely attach to the hair. The present invention provides such a single device that is concealed within the hair and provides secure attachment.

SUMMARY OF THE INVENTION

The invention is a hair fastening device comprised of a support member which has and a slidable securing member allowing the device to be wrapped in hair and then secured by sliding the securing member into place.

The details of the preferred embodiment of the present invention are set forth in the accompanying drawings and the description below. Once the details of the invention are known, numerous additional innovations an changes will become obvious to one skilled in the art.

DESCRIPTION OF THE PREFERRED EMBODIMENT

Throughout this description the preferred embodiment and examples shown should be considered as exemplars, rather than limitations on the structure of the present invention.

Figure 1:
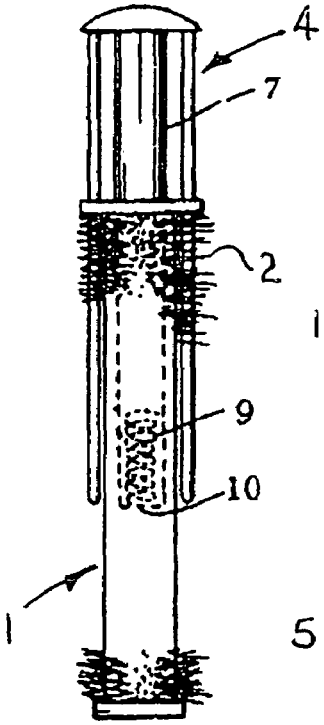
FIG. 1 is a side view of the support member with the securing member in the open position.
Figure 2:
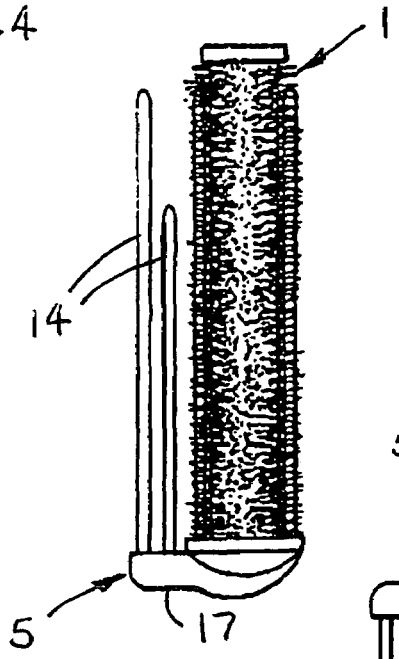
FIG. 2 is a side view of the support member with the securing member in the closed position.
Figure 3:
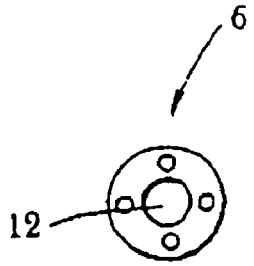
FIG. 3 is an overhead view of the guiding member bracket attached to the invention.
Figure 4:
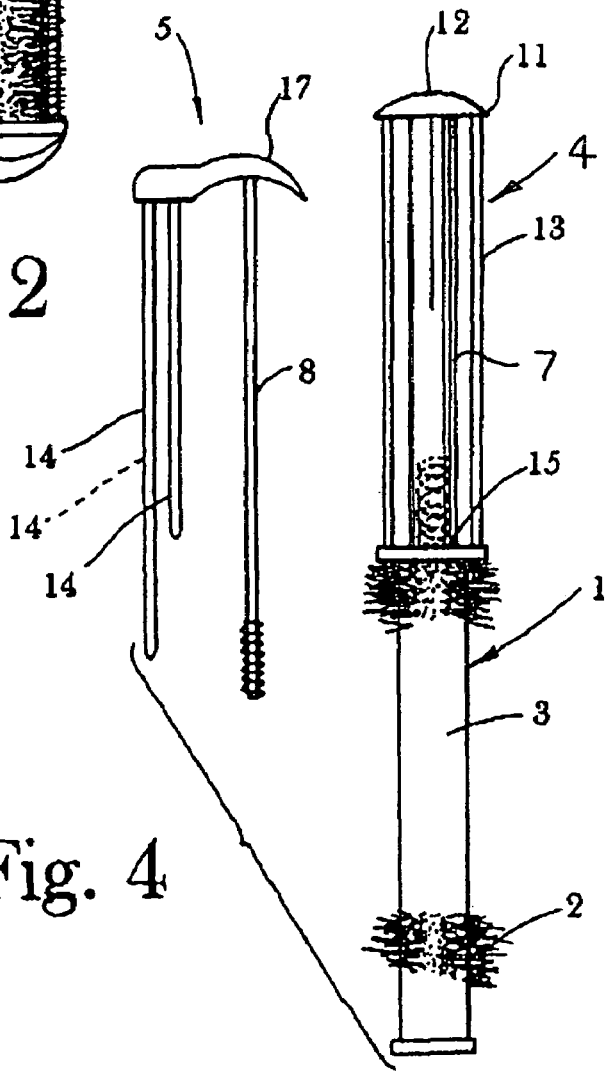
FIG. 4 is a side view of the second securing member.
Figure 5:
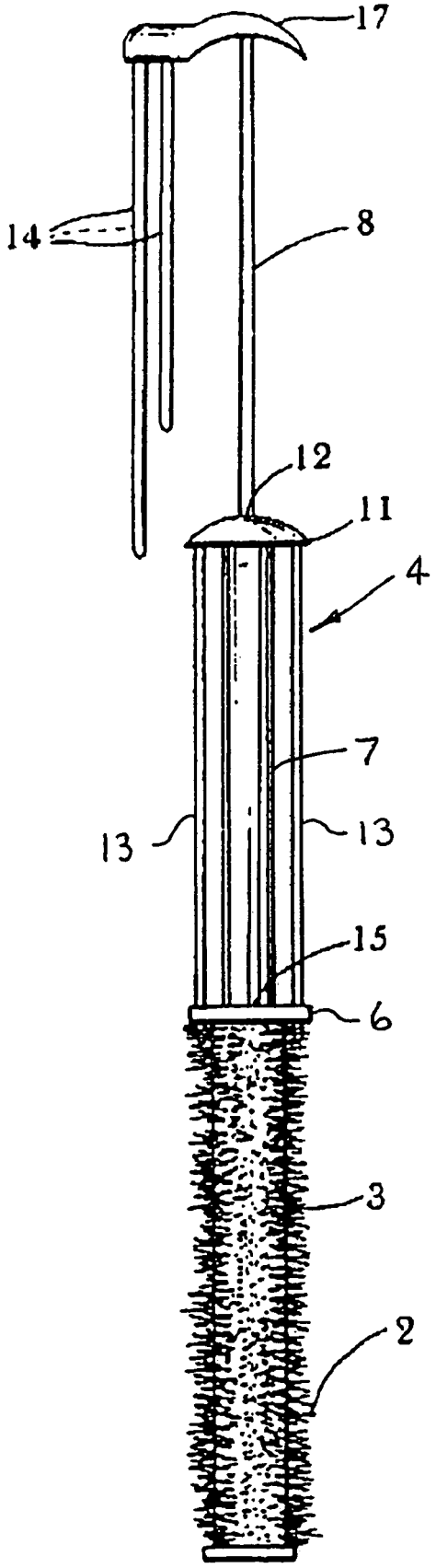
FIG. 5 is a an side view of the support member with the securing member in an open position demonstrating the attachment of the second securing member.

FIG. 1 shows a side of view of the support member 1 having a plurality of bristles 2 attached to the outside of the body of the center-tube of support member projecting out of the center-tube. The bristles are generally, but not necessarily parallel.

At the receiving end of the support member, a securing member 4 can be attached to the center-tube 3 by a complimentary center-pin 7 that slides into the center-tube at the opening 15 on the receiving end of the center-tube. The center-pin and a multitude of prongs 13 are attached to the securing member at the cross-bar 11. The securing member is 4 held in the closed position inside the center-tube by means of a locking member 12 on the cross-bar. A corresponding locking member 12 is located on the support member. An elastic means 9 may be used at the attached end of the center-pin of the securing member to apply force to the center-pin causing it to slide out of the center-tube when a locking member 12 is released. A retaining member 10 may be attached to the center-pin inside the center-tube which is larger than the opening 15 at the receiving end of the center-tube to prevent the center pin from separating from the center-tube. A guiding member 6 is attached to the receiving end of the support member having apertures corresponding to the multitude of prongs and the center-pin.

An second securing member 5 can be attached to the support member by the same means. The center-pin of the first securing member may be hollow and the center-pin 8 of the second securing member can then be attached by sliding the center-pin of the second securing member into the hollow opening of the center-pin of the first securing member. A multitude of prongs 14 are attached to the second securing member so that when the second securing member is attached to the support member the hair is more firmly held to the support member. The center-pin 8 and the multitude of prongs 14 are attached to a cross bar 17. It is understood that the invention is not limited to the embodiments set forth herein for purposes of example, but is to be limited only by the scope of the attached claim or claims.

Accordingly,

I claim:

1. A hair fastening device for rolling a person's hair and securing the hair in a rolled condition, said device comprising:

an elongated support member including an elongated hollow center tube and a plurality of hair engaging bristles disposed along and projecting out of said center tube;

a first securing member attached to said center tube and including an elongated center pin that slides into said center tube at an opening at a receiving end of said center tube for securing hair rolled onto said center tube, said first securing member including plural elongated prongs extending substantially parallel to said center pin of said first securing member and extendable over said center tube in response to extending said center pin of said first securing member within said center tube, said prongs being connected to said center pin of said first securing member at one end thereof; and a second securing member including a center pin extending within a hollow interior of said center pin of said first securing member by sliding said center pin of said second securing member into said center pin of said first securing member, said second securing member including plural elongated prongs connected to said center pin of said second securing member and extending substantially parallel thereto for securing hair more firmly to said support member, said second securing member includes a crossbar secured to said center pin of said second securing member at one end thereof and said crossbar is secured to said prongs of said second securing member, said prongs of said second securing member being spaced from and substantially parallel to said center pin of said second securing member.

2. The hair fastening device set forth in claim 1 wherein:

said prongs of said first securing member are slidable within a guide member attached to said receiving end of said center tube.

3. The hair fastening device set forth in claim 2 wherein:

said guide member includes plural spaced apart apertures formed therein for receiving respective ones of said prongs of said first securing member.

4. The hair fastening device set forth in claim 1 including:

a retaining member attached to said center pin of said first securing member.

5. The hair fastening device set forth in claim 1 including:

cooperating locking members formed on said first securing member and said support member for holding first securing member in a position with said center pin of said first securing member disposed within said center tube.

6. A hair fastening device for rolling a person's hair and securing the hair in a rolled condition, said device comprising:

an elongated support member including an elongated cylindrical center tube, a guide member at a receiving end of said center tube and a plurality of hair engaging bristles disposed along and projecting out of said center tube about the circumference of said center tube;

a first securing member attached to said center tube and including an elongated center pin that slides into said center tube of said support member at an opening at said receiving end of said center tube for securing hair rolled onto said center tube, said securing member including plural spaced apart elongated prongs extending substantially parallel to said center pin of said first securing member and extendable through said guide member and over said center tube in response to extending said center pin of said first securing member within said center tube, said prongs of said first securing member being attached to a crossbar member of said first securing member, said crossbar member being secured to said center pin of said first securing member at one end thereof; and a second securing member including a center pin extending within a hollow interior of said center pin of said first securing member by sliding said center pin of said second securing member into said center pin of said first securing member, said second securing member including plural elongated prongs spaced apart from each other and spaced from said center pin of said second securing member and connected to said center pin of said second securing member, said prongs of said second securing member extending substantially parallel to and spaced from said prongs of said first securing member for securing hair more firmly to said support member.

* * * * *